US009730565B2

(12) United States Patent
Chen

(10) Patent No.: US 9,730,565 B2
(45) Date of Patent: Aug. 15, 2017

(54) VACUUM DEVICE

(71) Applicant: Lumiplus Technology (Suzhou) Co., Ltd., Taicang (CN)

(72) Inventor: Shun-Yi Chen, Taipei (TW)

(73) Assignee: LUMIPLUS TECHNOLOGY (SUZHOU) CO., LTD., Taicang (CN)

( * ) Notice: Subject to any disclaimer, the term of this patent is extended or adjusted under 35 U.S.C. 154(b) by 0 days.

(21) Appl. No.: 15/063,889

(22) Filed: Mar. 8, 2016

(65) Prior Publication Data

US 2017/0100009 A1 Apr. 13, 2017

(30) Foreign Application Priority Data

Oct. 13, 2015 (TW) ..... 104216378 U

(51) Int. Cl.

| | |
|---|---|
| ***A47L 9/28*** | (2006.01) |
| ***A47L 9/14*** | (2006.01) |
| ***A47L 9/22*** | (2006.01) |
| ***A47L 11/24*** | (2006.01) |

(52) U.S. Cl.

CPC ..... *A47L 9/2821* (2013.01); *A47L 9/1409* (2013.01); *A47L 9/22* (2013.01); *A47L 11/24* (2013.01); *A47L 2201/06* (2013.01)

(58) Field of Classification Search

CPC .... A47L 9/2815; A47L 9/2821; A47L 9/1409; A47L 9/22; A47L 11/24; A47L 2201/06; A47L 9/28

USPC ..... 15/347

See application file for complete search history.

(56) References Cited

FOREIGN PATENT DOCUMENTS

DE 102012109938 * 4/2014

* cited by examiner

*Primary Examiner* — David Redding

(74) *Attorney, Agent, or Firm* — WPAT, PC

(57) ABSTRACT

A vacuum device includes a device body, a dust-collecting box, a fan and a detection unit. The device body further has a duct outlet and a fan outlet. The dust-collecting box located inside the device body is spatially connected to the duct outlet. The fan located inside the device body at a place beside the dust-collecting box is spatially connected to the fan outlet. The detection unit located close to the fan outlet further includes a sensor and a rotation assembly; in which the sensor further has an infrared-emitting component and an infrared-receiving component, the rotation assembly is able to pass rotationally through a space between the infrared-emitting component and the infrared-receiving component, and the infrared-emitting component is to emit an infrared to the infrared-receiving component for detecting the rotation assembly.

5 Claims, 3 Drawing Sheets

100

VACUUM DEVICE

This application claims the benefit of Taiwan Patent Application Serial No. 104216378, filed Oct. 13, 2015, the subject matter of which is incorporated herein by reference.

BACKGROUND OF INVENTION

1. Field of the Invention

The invention relates to a vacuum device, and more particularly to the vacuum device that the airflow thereof at a flow outlet can be detected.

2. Description of the Prior Art

To the vacuum device in the art, a fan, a filter member and a dust-collecting box are generally built inside the device body, in which the fan is to provide an airflow for sucking foreign dusts, particles and small-size garbage into the dust-collecting box of the vacuum device via the filter member. Also, the clean airflow posterior to the filter member after leaving the dusts, the particles and the garbage inside the device body is then exhausted to the atmosphere.

However, since the dust-collecting box is conventionally mounted inside the device body of the vacuum device, thus, to a user, the instant amount of the dusts, the particles and the garbage collected inside dust-collecting box cannot be observed simply by naked eyes. Therefore, the user usually needs to disassemble the vacuum device frequently for checking the volume collected inside the dust-collecting box, such that the vacuum device can ensure its vacuum performance. Obviously, the aforesaid management upon the conventional vacuum device is somehow cumbersome to the ordinary user. In addition, in some cases, the busy user is quite possible to forget the investigation upon the volume collected inside the dust-collecting box, and thus ill vacuum performance or serious jam at the sucking inlet may occur because of failing to empty the dust-collecting box in time. Under this circumstance, the dust-collecting box may be run without significant efficiency, and thus ill vacuum performance and the waste in energy to the vacuum device are definitely inevitable.

SUMMARY OF THE INVENTION

Accordingly, it is the primary object of the present invention to provide a vacuum device, in which a blocking mechanism is introduced to a fan outlet for detecting a speed of a rotation assembly. By providing changes in the speed of the rotation assembly, the condition of dusts jamming a duct outlet or filling a dust-collecting box can be realized.

In the present invention, the vacuum device includes a device body, a dust-collecting box, a fan and a detection unit. The device body further has a duct outlet and a fan outlet. The dust-collecting box located inside the device body is spatially connected to the duct outlet. The fan located inside the device body at a place beside the dust-collecting box is spatially connected to the fan outlet. The detection unit located close to the fan outlet further includes a sensor and a rotation assembly; in which the sensor further has an infrared-emitting component and an infrared-receiving component, the rotation assembly is able to pass rotationally through a space between the infrared-emitting component and the infrared-receiving component, and the infrared-emitting component is to emit an infrared to the infrared-receiving component for detecting the rotation assembly.

In one embodiment of the present invention, the sensor further has an infrared-emitting component and an infrared-receiving component, In one embodiment of the present invention, the rotation assembly is a fan assembly.

In one embodiment of the present invention, the fan is to provide an airflow to exhaust through the fan outlet by passing through the detection unit, wherein the rotation assembly is rotated according to the speed of the airflow of the fan.

In one embodiment of the present invention, the speed of the fan is increased as the rotation assembly rotates slower.

In one embodiment of the present invention, the vacuum device further includes a filter member located between the dust-collecting box and the fan.

In the vacuum device of the present invention, the blocking mechanism at the fan outlet is introduced to detect the speed of the rotation assembly. By knowing the change in the speed of the rotation assembly, the condition of the dusts jamming the duct outlet or filling the dust-collecting box can be realized. As the rotation assembly runs slower, the speed of the fan can be increased so as to increase the dust-exhausting capacity at the duct outlet.

All these objects are achieved by the vacuum device described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a vacuum device. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
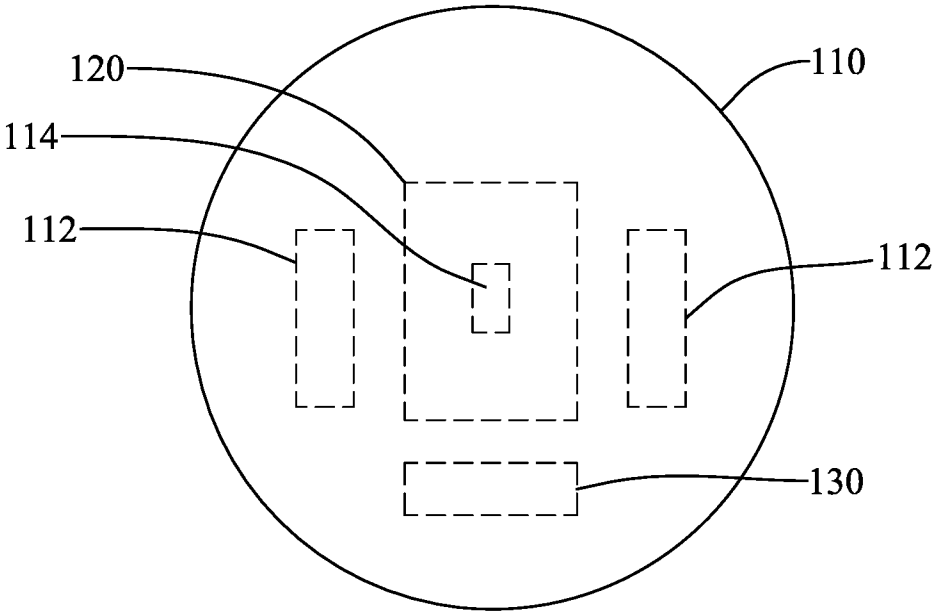
FIG. 1 is a schematic view of the vacuum device in accordance with the present invention.
Figure 2:
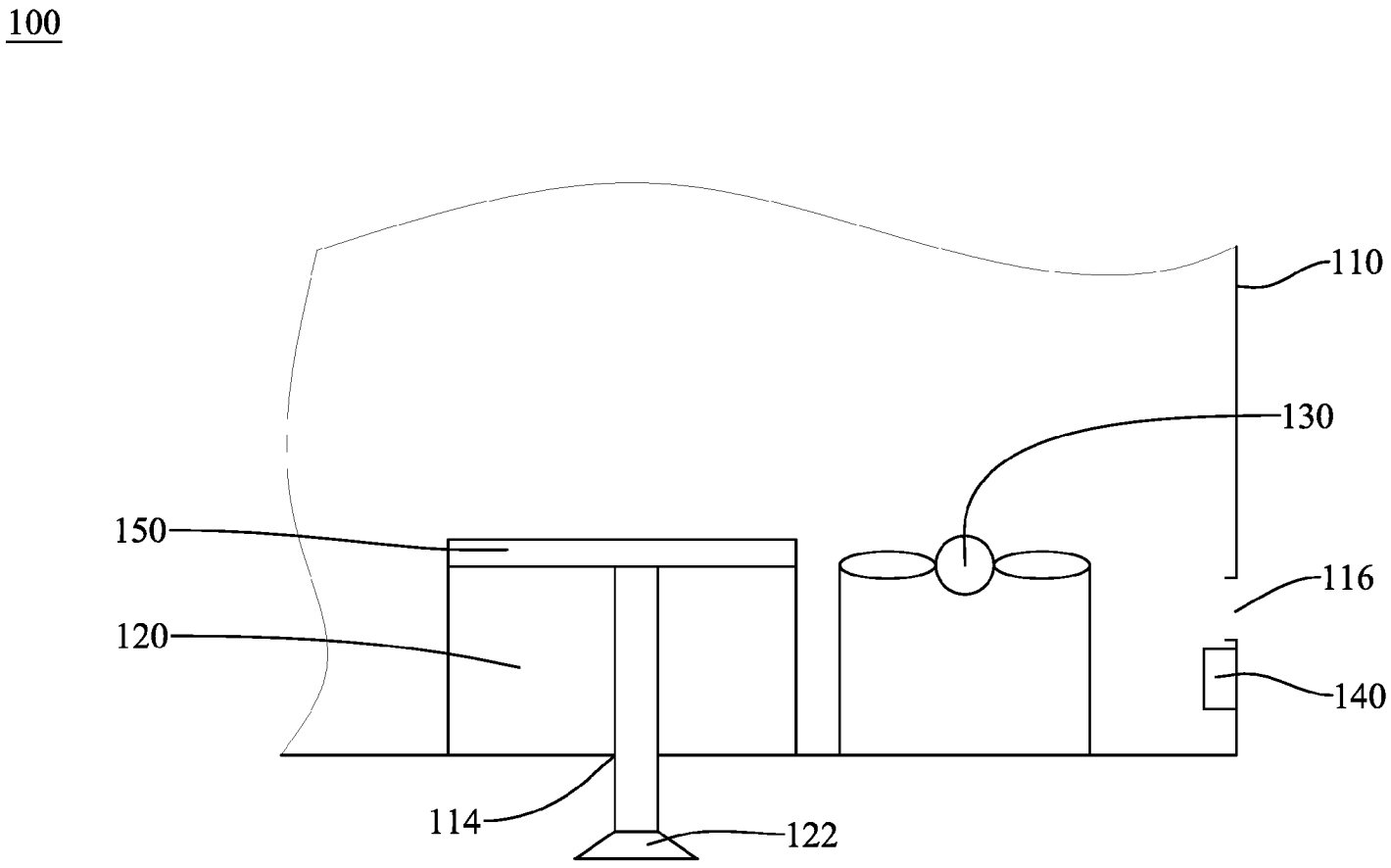
FIG. 2 is a schematic view of a portion inside the vacuum device of FIG. 1.
Figure 3:
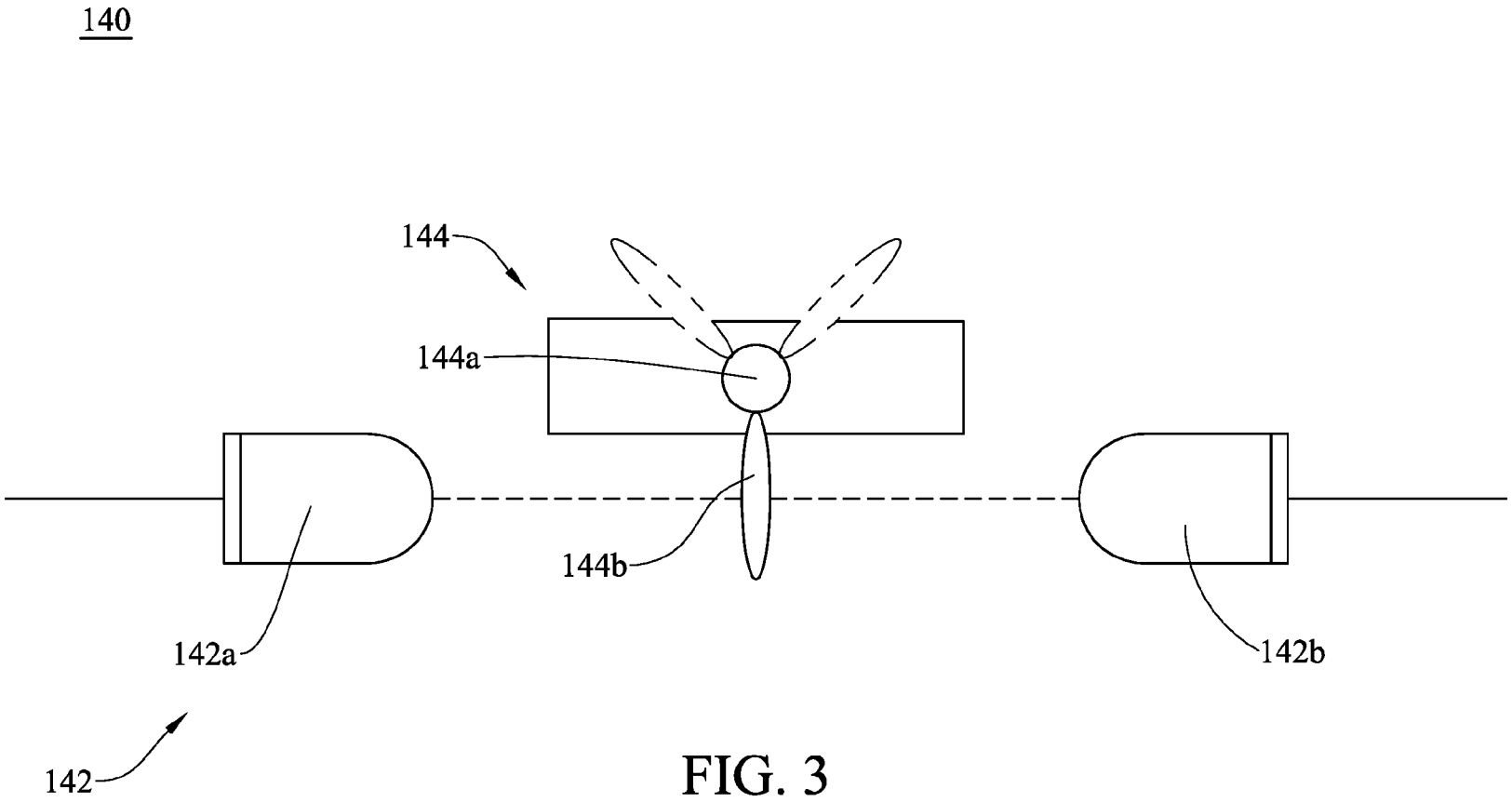
FIG. 3 shows schematically a preferred arrangement for detecting dusts at the duct outlet of the vacuum device of FIG. 1.

Refer to FIG. 1, FIG. 2 and FIG. 3; in which FIG. 1 is a schematic view of the vacuum device in accordance with the present invention, FIG. 2 is a schematic view of a portion inside the vacuum device of FIG. 1, and FIG. 3 shows schematically a preferred arrangement for detecting dusts at the duct outlet of the vacuum device of FIG. 1. As shown, in this embodiment, the vacuum device 100 can be, but not limited to, an intelligent clean-service robot for automatically performing a vacuum-cleaning job, or a conventional vacuum device hand-held for performing the vacuum-cleaning job.

The vacuum device 100 includes a device body 110, a dust-collecting box 120, a fan 130, a detection unit 140 and a filter member 150.

The device body 110 has two driving wheels 112. The device body 110 has a duct outlet 114 spatially communicative to the atmosphere and a fan outlet 116, in which the duct outlet 114 is located at a bottom portion of the device body 110 and the fan outlet 116 is located laterally to the device body 110.

The dust-collecting box 120 is located inside the device body 110 and is spatially connected to the duct outlet 114. The dust-collecting box 120 has a dust-sucking pipe 122 spatially connected to the dust-collecting box 120. In particular, the dust-sucking pipe 122 penetrates the duct outlet 114 and protrudes out of the device body 110.

The fan 130 is located inside the device body 110 at a place beside the dust-collecting box 120. The fan 130 is spatially communicative to the fan outlet 116 so as to provide an airflow for carrying and collecting the dusts into the dust-collecting box 120 through the duct outlet 11.

The detection unit 140 is located close to the fan outlet 116 and further includes a sensor 142 and a rotation assembly 144.

The sensor 142 has an infrared-emitting component 142*a* and an infrared-receiving component 142*b*.

The rotation assembly 144, a fan assembly for example, has, but not limited to, a rotational shaft 144*a* and at least one fan leaf 144*b* (three shown in FIG. 3) connected to the rotational shaft 144*a*.

The rotation assembly 144 can be rotationally sent through the space between the infrared-emitting component 142*a* and the infrared-receiving component 142*b*. The infrared-emitting component 142*a* is to emit an infrared to irradiate the infrared-receiving component 142*b*. The infrared is used to detect if the rotation assembly 144 passes therethrough the aforesaid space. As shown in FIG. 3, the fan leaf 144*b* of the rotation assembly 144 is to rotate about the rotational shaft 144*a*, and a speed of the fan leaf 144*b* of the rotation assembly 144 is determined in accordance with the speed of the airflow generated by the fan 130.

The filter member 150, a filtration net for example, is located between the dust-collecting box 120 and the fan 130.

Upon the aforesaid arrangement, the fan 130 for producing the airflow can drive the dusts to be collected inside dust-collecting box 120 through the duct outlet 114. After the airflow passes the filter member 150 to leave the dusts, the filtrated airflow is then to pass the detection unit 140 and further to be exhausted to the atmosphere through the fan outlet 116.

The rotation assembly 144 is rotated according to the speed of the airflow produced by the fan 130. As the dust-collecting box 120 still has enough space for accommodating the dusts, the speed of the fan 130 in this embodiment (a preset normal speed) is not further constrained. However, if the dust-collecting box 120 is almost filled with the collected dusts, then the actual speed of the airflow provided by the fan 130 would be less than the preset normal speed. Thereby, the vacuum capacity of the vacuum device for collecting foreign dusts would be reduced, and the rotation speed of the rotation assembly 144 would be lowered as well. As a consequence, the number of the rotation assembly 144 passing through the space between the infrared-emitting component 142*a* and the infrared-receiving component 142*b* would be also reduced, in which the number is infrared-detected by the sensor 142. Under this circumstance, it is known that the dust-collecting box 120 has been fed fully by the dusts. Further, the varying number of the rotation assembly 144 passing the aforesaid space can also be an index to tell if the duct outlet 114 is jammed by the dusts.

In addition, it shall be explained that, as the speed of the rotation assembly 144 becomes slower, an increase to the speed of the fan 130 would be substantially to increase the airflow driven by the fan 130. Thereupon, the capacity to handle the dusts would be increased as well. Hence, the speed of the fan 130 is also an index to tell if the dust-collecting box 120 is full of the dusts or if the duct outlet 114 is jammed by the dusts. At this full-dust time, if the resort of increasing the speed of the fan 130 can't sustain a normal vacuum operation, then a message to inform the user for empting the dust-collecting box 120 or cleaning the duct outlet 114 is necessary.

In summary, in the vacuum device of the present invention, the blocking mechanism at the fan outlet is introduced to detect the speed of the rotation assembly. By knowing the change in the speed of the rotation assembly, the condition of the dusts jamming the duct outlet or filling the dust-collecting box can be realized. As the rotation assembly runs slower, the speed of the fan can be increased so as to increase the dust-exhausting capacity at the duct outlet.

While the present invention has been particularly shown and described with reference to a preferred embodiment, it will be understood by those skilled in the art that various changes in form and detail may be without departing from the spirit and scope of the present invention.

What is claimed is:

1. A vacuum device, comprising:

a device body, further having a duct outlet and a fan outlet;

a dust-collecting box, located inside the device body, connected spatially to the duct outlet;

a fan, located inside the device body at a place beside the dust-collecting box, connected spatially to the fan outlet; and a detection unit, located close to the fan outlet, further including sensor and a rotation assembly, wherein the sensor further has an infrared-emitting component and an infrared-receiving component, wherein the rotation assembly is able to pass rotationally through a space between the infrared-emitting component and the infrared-receiving component, wherein the infrared-emitting component is to emit an infrared to the infrared-receiving component for detecting the rotation assembly;

wherein, the fan is to provide an airflow to exhaust through the fan outlet by passing through the detection unit, wherein the rotation assembly is rotated according to the speed of the airflow of the fan.

2. The vacuum device of claim 1, wherein the dust-collecting box further has a dust-sucking pipe spatially connected to the dust-collecting box, the dust-sucking pipe penetrating the duct outlet and protruding to the atmosphere through the device body.

3. The vacuum device of claim 1, wherein the rotation assembly is a fan assembly.

4. The vacuum device of claim 1, wherein the vacuum device is configured to increase the speed of the fan when the rotation assembly rotates slower.

5. The vacuum device of claim 1, further including a filter member located between the dust-collecting box and the fan.

* * * * *